US010100631B2

(12) United States Patent
Kalyanaraman et al.

(10) Patent No.: US 10,100,631 B2
(45) Date of Patent: Oct. 16, 2018

(54) METHOD OF TESTING A BARRIER IN A WELLBORE

(71) Applicant: Schlumberger Technology Corporation, Sugar Land, TX (US)

(72) Inventors: Ram Sunder Kalyanaraman, Vaucresson (FR); Cosan Ayan, Istanbul (TR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 560 days.

(21) Appl. No.: 14/564,913

(22) Filed: Dec. 9, 2014

(65) Prior Publication Data

US 2015/0159480 A1 Jun. 11, 2015

Related U.S. Application Data

(60) Provisional application No. 61/913,958, filed on Dec. 10, 2013.

(51) Int. Cl.

| | |
|---|---|
| ***E21B 33/124*** | (2006.01) |
| ***E21B 47/06*** | (2012.01) |
| ***E21B 49/00*** | (2006.01) |
| ***E21B 47/10*** | (2012.01) |

(52) U.S. Cl.
CPC ..... *E21B 47/06* (2013.01); *E21B 33/124* (2013.01); *E21B 47/1025* (2013.01)

(58) Field of Classification Search
CPC ..... E21B 47/06; E21B 47/1025
See application file for complete search history.

(56) References Cited

U.S. PATENT DOCUMENTS

| | | | | |
|---|---|---|---|---|
| 5,396,956 | A * | 3/1995 | Cherewyk | E21B 17/1007 166/191 |
| 7,631,699 | B2 * | 12/2009 | Cisneros | E21B 23/04 166/208 |
| 8,739,873 | B2 * | 6/2014 | Rogers | E21B 33/1208 166/119 |
| 8,991,492 | B2 * | 3/2015 | Lovell | E21B 17/206 166/250.17 |
| 2009/0173500 | A1 | 7/2009 | Orban et al. | |
| 2010/0186495 | A1 * | 7/2010 | Bekkeheien | E21B 49/008 73/152.22 |

* cited by examiner

*Primary Examiner* — Giovanna C. Wright
*Assistant Examiner* — Brandon M Duck
(74) *Attorney, Agent, or Firm* — Eileen Pape

(57) ABSTRACT

A method of testing a barrier in a wellbore that includes isolating a volume in the wellbore between an isolation device connected with an apparatus and the barrier, and pressure testing the barrier using the apparatus to adjust the pressure in the volume.

11 Claims, 4 Drawing Sheets

METHOD OF TESTING A BARRIER IN A WELLBORE

CROSS-REFERENCE TO RELATED APPLICATIONS

This application claims benefit of U.S. Provisional Patent Application Ser. No. 61/913,958, filed Dec. 10, 2013, which is herein incorporated by reference.

FIELD OF THE DISCLOSURE

The disclosure generally relates to methods of testing barriers in wellbores.

BACKGROUND

Zones or portions of wellbores are often isolated from one another. The barriers used to isolate the zones need to be tested for hydraulic integrity and pressure integrity.

Traditional methods of testing the barriers include applying pressure from the surface to the whole volume of the wellbore between the barrier and the surface. The traditional methods of testing barriers can cause damage to the wellbore or to the integrity of the pre-existing annulus barriers.

SUMMARY

An example method of testing a barrier in a wellbore includes isolating, downhole, a volume in the wellbore between an isolation device connected with an apparatus and the barrier. The method also includes pressure testing the barrier using the apparatus to increase or decrease the isolated volume and monitoring the pressure response.

Another example method for testing a barrier in a wellbore includes conveying an apparatus into a wellbore. The apparatus includes a body. An isolation device is connected with the body, and a chamber is located within the body. The apparatus also has a pump located within the body. A port is in communication with the pump and the chamber. The method further includes actuating the isolation device, and performing a pressure test on the barrier.

DETAILED DESCRIPTION OF THE INVENTION

Figure 1:
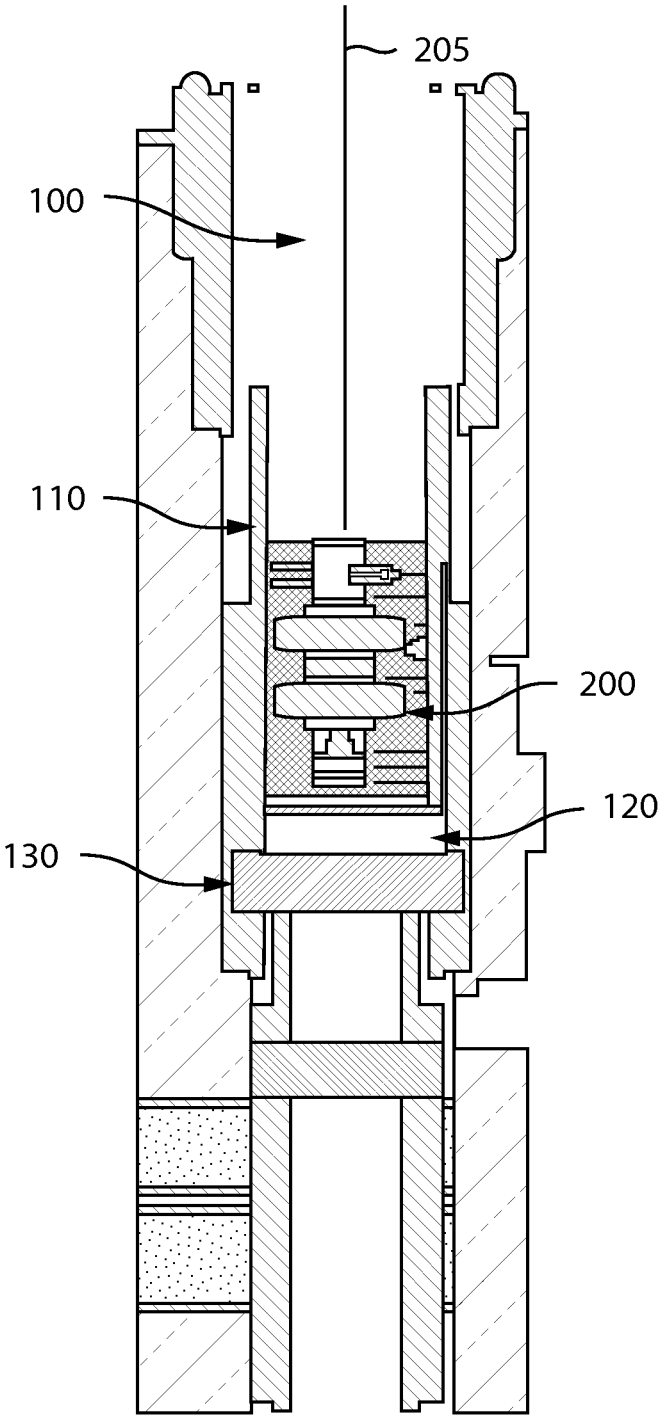
FIG. 1 depicts a schematic of an apparatus operatively located in a wellbore.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example method for testing a barrier in a wellbore includes conveying an apparatus into a wellbore. The apparatus can be conveyed into the wellbore using a wireline, slickline, coiled tubing, or the like. The barrier can be a bridge plug, a cement plug, shoe track cement, float collar, a frac plug, or the like. The tested barrier could also be the general well-bore (including the casing or liner or tubing) below the isolating device.

The apparatus includes a body. The body can be an elongated tubular member. The body can be made from any material. Illustrative materials include metal, composites, or the like.

An isolation device can be connected with the body. The isolation device can be any isolation device. Illustrative isolation devices include inflatable retrievable packers, seals, or the like.

The body can have any number of chambers and any number of pumps located therein. The chamber can have any number of segments. For example, the chamber can be a single reservoir. In another example, the chamber can include multiple reservoirs that are isolated from one another by flow barriers, and the flow barriers can include flow control devices, allowing the segments of the chamber to be placed in selective communication with one another or isolated from one another. In another embodiment the chamber can include an adjustable bladder, piston, or other device that can be operated to change the volume of the chamber.

The chamber can be in selective fluid communication with an isolated volume between a barrier and the isolation device on the apparatus. Accordingly, the volume of the chamber can be adjusted to increase or decrease the isolated volume. For example, the chamber can be a segment chamber and flow control device can be activated to prevent or allow fluid communication between the segments and the isolated volume. In another embodiment, the apparatus can include multiple chambers, and each of the chambers can be selective fluid communication with the isolated volume, and flow control devices can be operatively connected with the apparatus to control the number of chamber that are in communication with the isolated volume. The flow control devices can be operated using now known or future known techniques.

In yet another example, the chamber can have a piston located therein and the piston can be operated to adjust the volume of the chamber to adjust the isolated volume. The piston can be operated using any now known or future known techniques and control equipment. A bladder or other similar device can be used in place of the piston, and the bladder or other similar device can be operated using now known or future known techniques and control equipment. The control equipment can be located on the apparatus and can be configured to perform predetermined tasks in response to predetermined events. For example, the control equipment can be configured to operate the pump after the isolation devices are deployed, to decrease the volume of the chamber at a predetermined rate, the control equipment can include memory and the memory can store acquired data such as pressure changes or the like. In another embodiment, the control equipment can be at the surface and can communicate with the apparatus to deploy the isolation device, operate flow control devices, provide power to the apparatus, receive acquired data from sensors on the apparatus, and send signals to the apparatus.

The chamber can be used as a reservoir for storing a test fluid. The test fluid can be any suitable fluid, one skilled in the art with the aid of this disclosure would know what suitable fluids can be used. The chamber, in an embodiment, can be used to store wellbore fluid that is removed from a volume between the barrier and the isolation device. The pump can be any kind of pump.

The apparatus also has a port in communication with the pump and the chamber. The port can be used to remove wellbore fluid or provide test fluid to the volume between the barrier and the isolation device. A valve can be operatively connected with the apparatus, and the valve can be used to open and close the port.

The example method can also include actuating the isolation device. The isolation device can be actuated using now known or future known methods of actuation. The actuated isolation device can seal with the walls of the wellbore to isolate the wellbore fluid in the volume between the barrier and the isolation device from other wellbore fluid.

The example method also includes performing a pressure test on the barrier. The pressure test can be performed by adding test fluid to the volume between the barrier and the isolation device or removing wellbore fluid from the volume between the isolation device and the barrier.

In an embodiment, the method can include testing to confirm that the isolation device has sealed with the walls of the wellbore. The testing can include increasing or decreasing the pressure of wellbore fluid between the isolation device and the barrier. The pressure can be increased or decreased by changing the amount of fluid in the volume between the barrier and the isolation device or changing the volume between the isolation device and the barrier. The test also includes noting the change in pressure in comparison with hydrostatic pressure. Another method of testing the seal formed by the isolation device can include using two transducers to measure the pressure on opposite sides of the isolation device.

Another example method of testing a barrier in a wellbore includes isolating a volume in the wellbore between an isolation device connected with an apparatus and the barrier, and pressure testing the barrier using the apparatus to adjust the volume (increase or decrease the isolated volume). The isolated volume can be increased by opening a valve or other closure device that is located on the body of the apparatus and in fluid communication with the inner chamber of the apparatus. Accordingly, the isolated volume would be increased. The isolated volume can be decreased by providing a piston, bladder, or other device that can be actuated to adjust the volume of the inner chamber. In another embodiment, the apparatus can be deployed with the valve in an open configuration provided a flow path exterior of the apparatus to the chamber, and the isolation device can be actuated to isolate the volume between the apparatus and the barrier; the valve can be closed after the volume is isolated; thereby, decreasing the volume of the isolated volume.

In the disclosed methods an example of pressure testing the barrier can include injecting test fluid from the apparatus into the volume. For example, a pump, at a pre-determined rate, can inject test fluid into the volume between the packer and the barrier; thereby, increasing the pressure in the volume between the isolation device and barrier at a rate controlled by the pump rate, the compressibility of the wellbore fluid and test fluid, and the permeability of the barrier. A continuous measurement of pressure of the fluid between the isolation device and the barrier can be conducted using now known or future known pressure transient techniques to analyze the hydraulic transmissibility/isolation of the barrier. Another example of pressure testing the barrier can include increasing the pressure in the volume between the packer and the barrier to a pre-defined pressure level to test the integrity of the barrier to ensure that the barrier meets a stipulated pressure hold rating.

In another embodiment of the disclosed methods, pressure testing the barrier can include removing wellbore fluid from the volume. For example, the pump, at a pre-determined rate, can withdraw wellbore fluid from the volume between the isolation device and the barrier; thereby, decreasing the pressure in the volume between the isolation device and the barrier at a rate dependent on the pump rate, compressibility of the wellbore fluid, and permeability of the barrier. A continuous measurement of pressure of the wellbore fluid between the isolation device and the barrier can be used in now known or future known techniques to analyze the hydraulic transmissibility/isolation of the barrier.

The pressure of the volume between the isolation device can be measured using transducers, pressure gauges, or the like that are connected with the apparatus. The acquired pressure data can be sent to the surface using now known or future known methods of telemetry.

In an embodiment, the method can include testing the wellbore fluid using the apparatus. For example, any number of sensors in operative fluid communication with the wellbore fluid can be used to measure any number of properties of the wellbore fluid. The measured properties can be used to diagnose the nature of the wellbore fluids.

Figure 2:
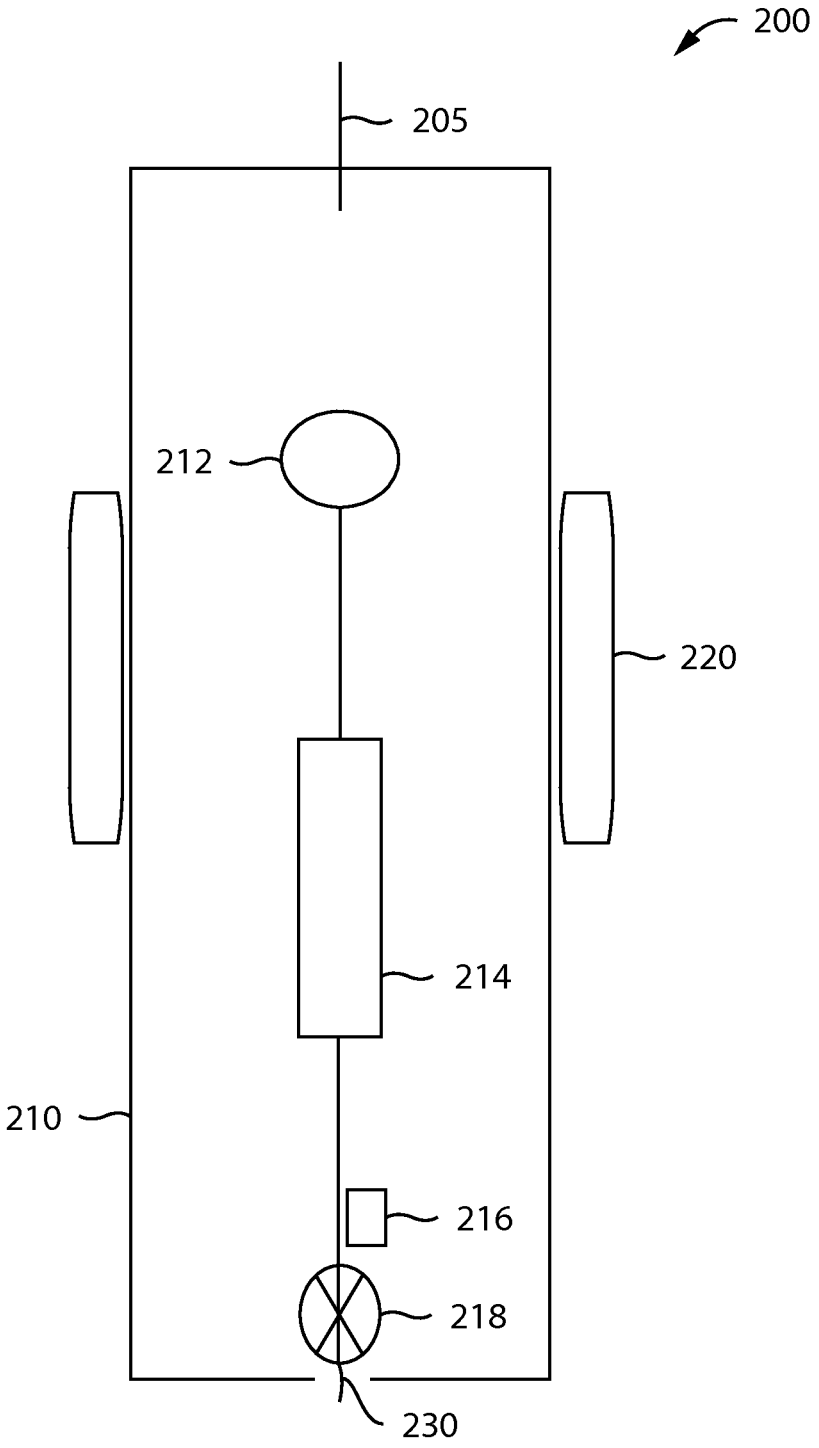
FIG. 2 depicts a schematic of an example apparatus.

FIG. 1 depicts a schematic of an apparatus operatively located in a wellbore. FIG. 2 depicts a schematic of an example apparatus.

Referring to FIGS. 1 and 2, an apparatus 200 can be conveyed into the wellbore 100. The apparatus 200 can be conveyed using a conveyance device 205. The conveyance device 205 can be a wireline, a slickline, coiled tubing, or the like.

The apparatus 200 can be located at a desired depth adjacent a barrier 130. The isolation device 220 can be actuated to engage the walls 110 of the wellbore 100, forming a seal. The isolation device 220 can be any number of packers or other sealing devices. A probe can be integrated with or operatively connected with the isolation device. In another embodiment the probe can be connected with the apparatus below the isolation device. The probe can be in fluid communication with the isolated volume to allow for sampling of fluids located in the isolated volume, injection of fluids into the isolated volume, or extraction of fluids from the isolated volume. In an embodiment, the apparatus can have a plurality of isolation devices spaced apart from one another.

A volume 120 is located between the barrier 130 and the isolation device 220. The volume 120 has wellbore fluid located therein. The isolation device 220 isolates the wellbore fluid in the volume 120 from other wellbore fluid.

The apparatus 200 has a body 210 that has the isolation device 220 located thereabout. The body 210 can house a pump 212, a chamber 214, a valve 218, pressure sensors 216, and other desired equipment or electronics. The other electronics or equipment can include sensors for analyzing fluid properties, memory, or control equipment. The sensors for analyzing fluid properties can include optical sensors, resistivity sensors, density sensors, or the like. In an embodiment, not shown, the apparatus 200 can have pressure sensors located on the body 210 on both sides of the isolation device 220. In another embodiment, the apparatus 200 can have a pressure sensor located on the body 210 between the isolation device 220 and a port 230.

The valve 218 can be selectively operated to control fluid communication between the chamber 214 and the port 230. The pump 212 can be in fluid communication with the chamber 214. The pump 212 can be operated to change the pressure in the volume 120. For example, the pump 212 can be operated to inject test fluid in the chamber 214 into the volume 120. In another example, the pump 212 can be operated to remove wellbore fluid from the volume 120.

Figure 3:
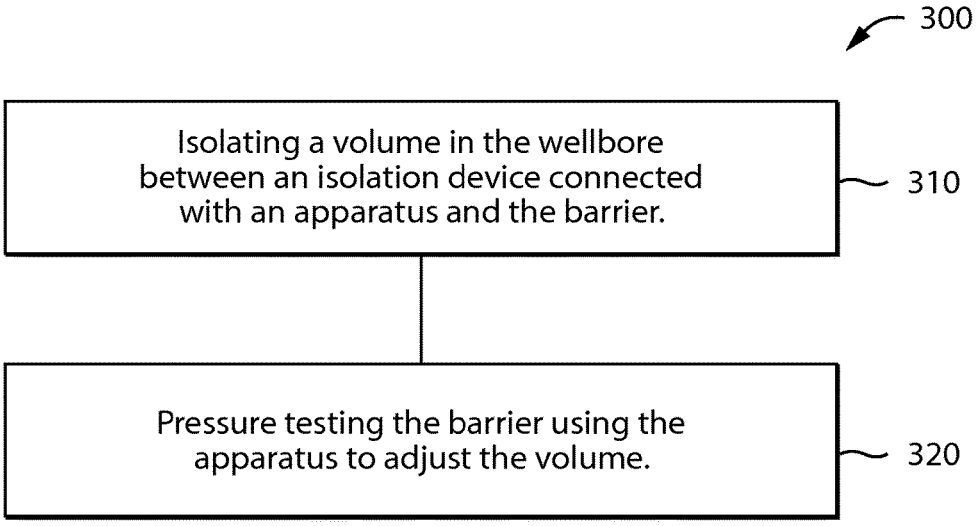
FIG. 3 depicts a flow diagram of an example method of testing a barrier in a wellbore.

FIG. 3 depicts a flow diagram of an example method testing a barrier in a wellbore.

The method 300 is depicted as a series of operations or blocks. The method 300 includes isolating a volume in the wellbore between an isolation device connected with an apparatus and the barrier (block 310).

The method further includes pressure testing the barrier using the apparatus to adjust volume (block 320). Adjusting the isolated volume can include increasing the isolated volume or decreasing the isolated volume.

Figure 4:
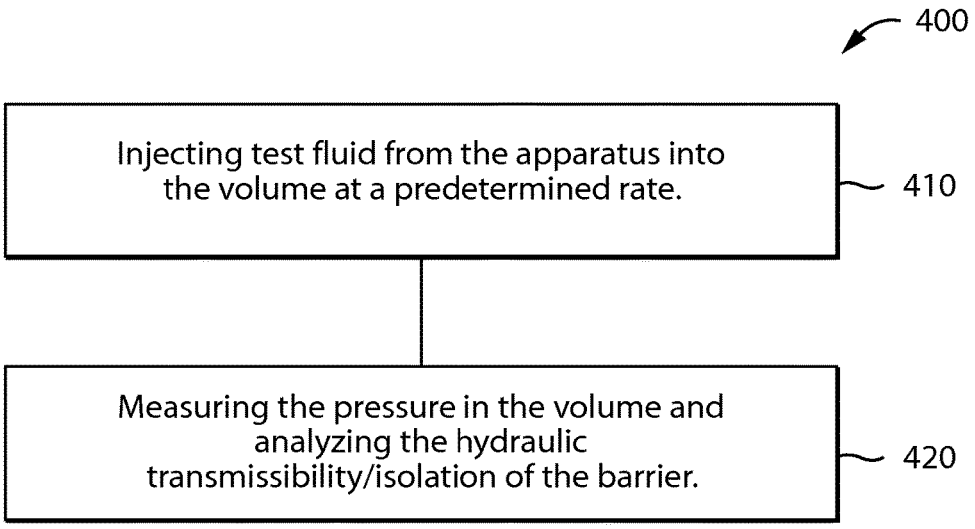
FIG. 4 depicts a flow diagram of an example of another method of pressure testing.

FIG. 4 depicts a flow diagram of an example of a method of pressure testing.

The method 400 includes injecting test fluid from the apparatus into the volume at a predetermined rate (block 410).

The method further includes measuring the pressure in the volume and analyzing the hydraulic transmissibility/isolation of the barrier (block 420).

Figure 5:
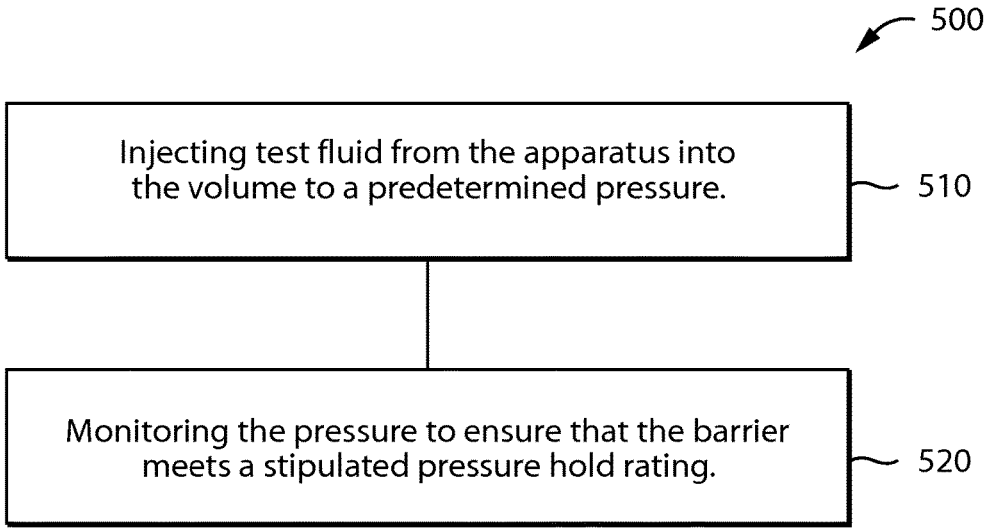
FIG. 5 depicts a flow diagram of an example of another method of pressure testing.

FIG. 5 depicts a flow diagram of an example of another method of pressure testing.

The method 500 includes injecting test fluid form the apparatus into the volume to a predetermined pressure (block 510). The method also includes monitoring the pressure to ensure that the barrier meets a stipulated pressure hold rating (block 520).

Figure 6:
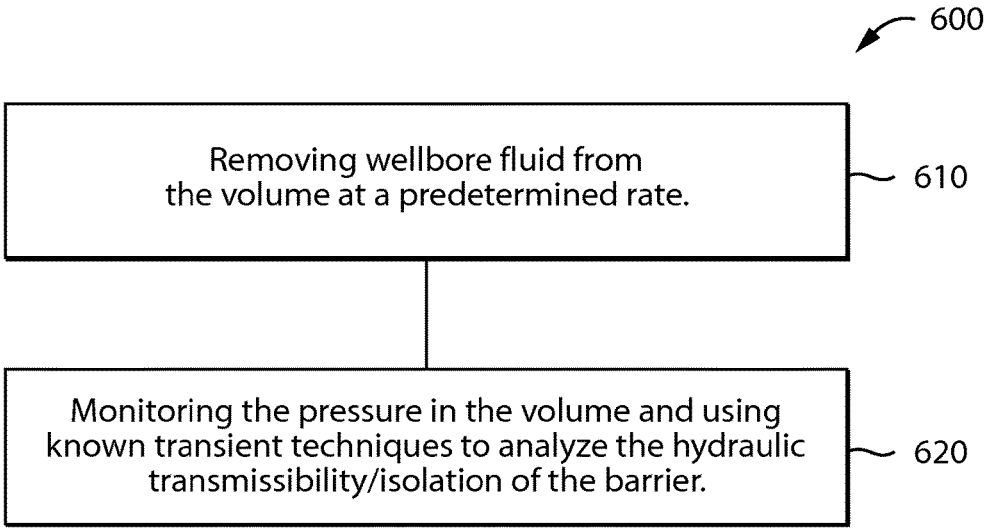
FIG. 6 depicts a flow diagram of an example of another method of pressure testing.

FIG. 6 depicts a flow diagram of an example of another method of pressure testing.

The method 600 includes removing wellbore fluid from the volume at a predetermined rate (block 610). The method also includes monitoring the pressure in the volume and using known transient techniques to analyze the hydraulic transmissibility/isolation of the barrier (block 620).

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A method for testing a barrier in a wellbore, wherein the method comprises:

conveying an apparatus into a wellbore, wherein the apparatus is positioned adjacent the barrier, wherein the apparatus comprises:

a body;

an isolation device located about the body, wherein the isolation device is configured to form a seal with walls of the wellbore;

a chamber within the body;

a pump within the body; and a port in communication with the pump and the chamber actuating the isolation device, forming a seal with the walls of the wellbore, thereby creating an isolated volume between the isolation device and the barrier; and performing a pressure test on the barrier by changing the pressure of the fluid in the isolated volume, changing the volume of the isolated volume, or combinations thereof using the apparatus.

2. The method of claim 1, wherein performing the pressure test on the barrier comprises injecting test fluid from the chamber into the isolated volume between the isolation device and the barrier.

3. The method of claim 1, wherein performing the pressure test on the barrier comprises removing fluid from the isolated volume.

4. The method of claim 1, further comprising confirming that the isolation device formed a seal with the walls of the wellbore.

5. The method of claim 4, wherein confirming that the isolation device formed a seal with the walls of the wellbore comprises increasing pressure in the fluid between the isolation device and the barrier and comparing the change in pressure to the hydrostatic pressure.

6. The method of claim 4, wherein confirming the isolation device formed a seal with the walls of the wellbore comprises measuring the pressure in the wellbore on both sides of the isolation device.

7. A method of testing a barrier in a wellbore, wherein the method comprises:

isolating a volume in the wellbore between an isolation device connected with an apparatus and the barrier, wherein the apparatus is conveyed into the wellbore using a wireline; and pressure testing the barrier using the apparatus to adjust the isolated volume, wherein using the apparatus to adjust the isolated volume comprises preventing fluid communication between the isolated volume and a chamber located in the apparatus, allowing fluid communication between the isolated volume and the chamber, or adjusting the volume of the chamber.

8. The method of claim 7, wherein pressure testing the barrier includes injecting test fluid from the apparatus into the volume.

9. The method of claim 7, wherein pressure testing the barrier includes removing wellbore fluid from the volume.

10. The method of claim 7, further comprising testing wellbore fluid using the apparatus.

11. The method of claim 7, further comprising testing a seal formed by the isolation device using two transducers to measure the pressure on opposite sides of the isolation device.

* * * * *